US009541888B2

(12) United States Patent
Hanano

(10) Patent No.: US 9,541,888 B2
(45) Date of Patent: Jan. 10, 2017

(54) IMAGE FORMING APPARATUS INCLUDING POLISHING ROLLER

(71) Applicant: KYOCERA Document Solutions Inc., Osaka-shi, Osaka (JP)

(72) Inventor: Susumu Hanano, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/758,498

(22) PCT Filed: Jan. 27, 2015

(86) PCT No.: PCT/JP2015/052116

§ 371 (c)(1),
(2) Date: Jun. 29, 2015

(87) PCT Pub. No.: WO2015/129364

PCT Pub. Date: Sep. 3, 2015

(65) Prior Publication Data

US 2016/0252870 A1 Sep. 1, 2016

(30) Foreign Application Priority Data

Feb. 27, 2014 (JP) ..... 2014-037485

(51) Int. Cl.
*G03G 21/00* (2006.01)
*G03G 21/10* (2006.01)

(52) U.S. Cl.
CPC ..... *G03G 21/0058* (2013.01); *G03G 21/0011* (2013.01); *G03G 21/0076* (2013.01);
(Continued)

(58) Field of Classification Search
CPC ..... G03G 21/0058; G03G 21/0076; G03G 21/0094; G03G 2221/001; G03G 2221/0089
(Continued)

(56) References Cited

U.S. PATENT DOCUMENTS 7,664,453 B2 * 2/2010 Morishita ..... G03G 21/0011 399/349
7,773,933 B2 * 8/2010 Ishino ..... G03G 9/09708 399/349
(Continued)

FOREIGN PATENT DOCUMENTS

JP 2007057592 A * 3/2007
JP 2007108269 A 4/2007
(Continued)

*Primary Examiner* — Robert Beatty
(74) *Attorney, Agent, or Firm* — Alleman Hall McCoy Russell & Tuttle LLP

(57) ABSTRACT

An image forming apparatus includes: a cleaning portion configured to remove toner stuck to a surface of an image carrier; a polishing roller that is rotatable while being in contact with the image carrier; a guide portion disposed with a gap having a predetermined width from an outer circumferential surface of the polishing roller, and configured to guide the removed toner to pass below the outer circumferential surface of the polishing roller; opening portions each formed in a predetermined size at a position below the lower portion of the outer circumferential surface of the polishing roller in the guide portion; and a housing including a wall surface that defines, together with an end of the guide portion in a rotation direction of the polishing roller, a falling path through which the toner falls from the end, the housing storing the cleaning portion and the polishing roller.

6 Claims, 5 Drawing Sheets

(52) U.S. Cl.
CPC ..... *G03G 21/10* (2013.01); *G03G 2215/0132* (2013.01); *G03G 2221/001* (2013.01)

(58) Field of Classification Search
USPC ..... 399/347, 349, 357
See application file for complete search history.

(56) References Cited

U.S. PATENT DOCUMENTS

| | | | | |
|---|---|---|---|---|
| 2008/0056786 | A1* | 3/2008 | Ishino ..... | G03G 21/0011 399/357 |
| 2012/0033986 | A1* | 2/2012 | Nakaegawa ..... | G03G 21/0035 399/71 |

FOREIGN PATENT DOCUMENTS

| | | | | |
|---|---|---|---|---|
| JP | 2008107613 | A | * | 5/2008 |
| JP | 2008158229 | A | | 7/2008 |
| JP | 2008170835 | A | * | 7/2008 |
| JP | 2009003327 | A | * | 1/2009 |
| JP | 2009104007 | A | * | 5/2009 |
| JP | 2009265314 | A | | 11/2009 |
| JP | 2015068839 | A | * | 4/2015 |

* cited by examiner

IMAGE FORMING APPARATUS INCLUDING POLISHING ROLLER

TECHNICAL FIELD

The present invention relates to an image forming apparatus including a polishing roller for polishing the surface of an image carrier by using toner.

BACKGROUND ART

In an electrophotographic image forming apparatus such as a copier, an image carrier such as a photoconductor drum is electrically charged by a charging device during an image forming process. Meanwhile, in this type of image forming apparatus, discharge products may be generated by the discharge that occurs when the image carrier is electrically charged by the charging device, and the discharge products may stick to the surface of the image carrier, thereby causing a failure such as an image flow. With regard to this problem, there is known a configuration for removing the discharge products that have stick to the surface of the image carrier, by causing toner, to which abrasive material has been externally added, to stick to the surface of a polishing roller and polishing the surface of the image carrier with the polishing roller (see, for example, PTL 1). More specifically, the toner removed from the surface of the image carrier is guided by a guide member which is disposed with a predetermined gap from the outer circumferential surface of the polishing roller. This allows toner passing through between the polishing roller and the guide member to stick to the surface of the polishing roller. On the other hand, toner that does not stick to the surface of the polishing roller is discharged from an end of the guide member in the rotation direction of the polishing roller.

CITATION LIST

Patent Literature

[PTL 1] Japanese Laid-Open Patent Publication No. 2009-265314

SUMMARY OF THE INVENTION

Problems to be Solved by the Invention

Meanwhile, in the above-described configuration, the toner guided to the end of the guide member falls from the end of the guide member along a falling path. Here, if the falling path has a narrow width, toner is likely to accumulate on the surfaces of the walls that define the falling path, and a toner clogging is likely to occur. On the other hand, if the width of the falling path is broadened to restrict the accumulation of the toner, the housing increases in size.

It is an object of the present invention to provide an image forming apparatus that can reduce the possibility of clogging with the toner discharged from the end of the guide portion and can make the downsizing of the housing possible, wherein the guide portion is disposed with a predetermined gap from the outer circumferential surface of the polishing roller.

Solution to the Problems

An image forming apparatus according to one aspect of the present invention includes a cleaning portion, a polishing roller, opening portions, and a housing. The cleaning portion is configured to remove toner that has stuck to a surface of an image carrier. The polishing roller is rotatable in the state where it is in contact with the image carrier. The guide portion is disposed with a gap having a predetermined width from an outer circumferential surface of the polishing roller, and is configured to guide the toner removed by the cleaning portion to pass below the outer circumferential surface of the polishing roller. The opening portions are each formed in a predetermined size at a position below the outer circumferential surface of the polishing roller in the guide portion. The housing includes a wall surface that defines, together with an end of the guide portion in a rotation direction of the polishing roller, a falling path through which the toner falls from the end. The housing stores the cleaning portion and the polishing roller.

Advantageous Effects of the Invention

According to the present invention, it is possible to reduce the possibility of clogging with the toner discharged from the end of the guide portion and can make the downsizing of the housing possible, wherein the guide portion is disposed with a predetermined gap from the outer circumferential surface of the polishing roller.

DESCRIPTION OF EMBODIMENTS

The following describes an embodiment of the present invention with reference to the accompanying drawings for the understanding of the invention. It should be noted that the following description is an example of a specific embodiment of the present invention and should not limit the technical scope of the invention.

[Outlined Configuration of Image Forming Apparatus 10]

Figure 1:
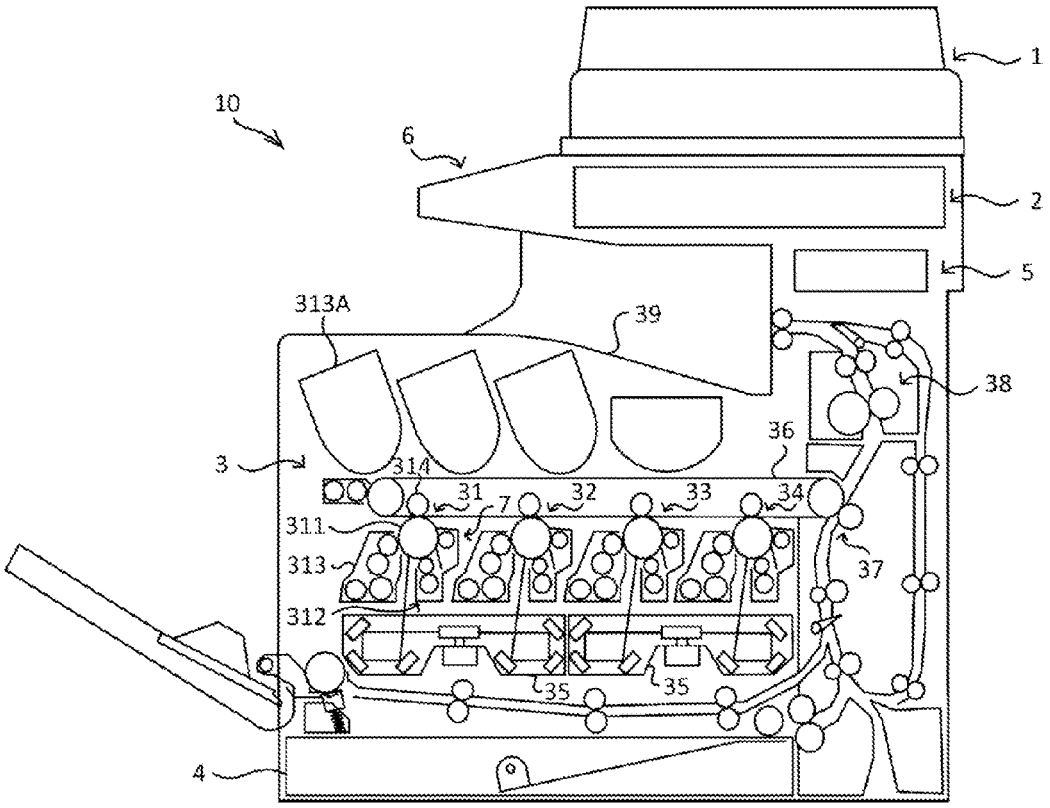
FIG. 1 is a diagram showing the configuration of an image forming apparatus according to an embodiment of the present invention.

First, an outlined configuration of an image forming apparatus 10 according to an embodiment of the present invention is described with reference to FIG. 1. As shown in FIG. 1, the image forming apparatus 10 includes an ADF 1, an image reading portion 2, an image forming portion 3, a sheet feed portion 4, a control portion 5, and an operation display portion 6. In addition, the present invention is applicable to an image forming apparatus such as a printer apparatus, a facsimile apparatus, and a copier.

In the ADF 1, conveying rollers are driven by motors (not shown) such that a document sheet placed on the document sheet setting portion is conveyed in such a way as to pass through an image data reading position where the image data is read by the image reading portion 2, and then conveyed to the sheet discharge portion. With this configuration, the image reading portion 2 can read the image data from the document sheet conveyed by the ADF 1.

The image reading portion 2 is an image reading portion for reading image data from the document sheet, and includes a document sheet table, a reading unit, a plurality of mirrors, an optical lens, and a CCD (Charge Coupled Device) that are not shown. The control portion 5 includes control equipment such as CPU, ROM, RAM, and EEPROM (registered trademark) that are not shown. The operation display portion 6 displays various types of information based on control instructions sent from the control portion 5.

As shown in FIG. 1, the image forming portion 3 includes a plurality of image forming units 31-34, an exposure device (LSU) 35, an intermediate transfer belt 36, a secondary transfer roller 37, a fixing device 38, and a sheet discharge tray 39. The image forming units 31-34 are electrophotographic image forming units that correspond to C (cyan), M (magenta), Y (yellow), and K (black), respectively. The image forming unit 31 includes a photoconductor drum 311, a charging device 312, a developing device 313, a primary transfer roller 314, and a cleaning device 7. In addition, each of the image forming units 32-34 has a similar configuration to the image forming unit 31. In the image forming portion 3, a color image is formed in the following procedure on a paper sheet supplied from the sheet feed portion 4, and the paper sheet with the image formed thereon is discharged onto the sheet discharge tray 39. Here, the photoconductor drum 311 is an example of the image carrier.

First, in the image forming unit 31, the charging device 312 charges the photoconductor drum 311 uniformly to a certain potential. Next, the exposure device 35 irradiates the surface of the photoconductor drum 311 with light based on the image data. With this operation, an electrostatic latent image corresponding to the image data is formed on the surface of the photoconductor drum 311. Then the electrostatic latent image on the photoconductor drum 31 is developed (visualized) as a cyan toner image by the developing device 313. It is noted that cyan toner (developer) is supplied to the developing device 313 from a toner container 313A that is attachable to and detachable from the image forming portion 3. Subsequently, the cyan toner image formed on the photoconductor drum 311 is transferred to the intermediate transfer belt 36 by the primary transfer roller 314. It is noted that the toner that has remained on the surface of the photoconductor drum 311 is removed by the cleaning device 7. The cleaning device 7 is described in detail below.

Next, in the image forming units 32-34, too, toner images of respective colors are formed on the photoconductor drums provided in the image forming units 32-34, by the same processing procedure as in the image forming unit 31. Subsequently, the toner images are transferred from the photoconductor drums to the intermediate transfer belt 36 in such a way as to be overlaid on the intermediate transfer belt 36 in order of cyan, magenta, yellow, and black. The toner image is then transferred, by the secondary transfer roller 37, from the intermediate transfer belt 36 to a paper sheet supplied from the sheet feed portion 4. Subsequently, the paper sheet on which the toner image has been transferred is sent to the fixing device 38 in which the toner image is fused and fixed, thereby an image is formed on the paper sheet. The paper sheet is then discharged onto the sheet discharge tray 39.

Meanwhile, in an image forming apparatus such as the image forming apparatus 10, discharge products may be generated by the discharge that occurs while the photoconductor drum 311 is electrically charged by the charging device 312, and the discharge products may stick to the surface of the image carrier, thereby causing a failure such as an image flow. With regard to this problem, there is known a configuration for removing discharge products that have stick to the surface of the photoconductor drum 311, by causing toner, to which abrasive material has been externally added, to stick to the surface of a polishing roller and polishing the surface of the photoconductor drum 311 with the polishing roller. More specifically, the toner removed from the surface of the photoconductor drum 311 is guided by a guide member which is disposed with a predetermined gap from the outer circumferential surface of the polishing roller. This allows toner passing through between the polishing roller and the guide member to stick to the surface of the polishing roller. On the other hand, toner that does not stick to the surface of the polishing roller is discharged from an end of the guide member in the rotation direction of the polishing roller.

In addition, in the above-described configuration, the toner guided to the end of the guide member falls from the end of the guide member along a falling path. Here, if the falling path has a narrow width, toner is likely to accumulate on the surfaces of the walls that define the falling path, and a toner clogging is likely to occur. On the other hand, if the width of the falling path is broadened to restrict the accumulation of the toner, the housing increases in size. With regard to these problems, in the image forming apparatus 10, the possibility of the toner clogging is reduced and the downsizing of the housing is made possible.

Figure 2:
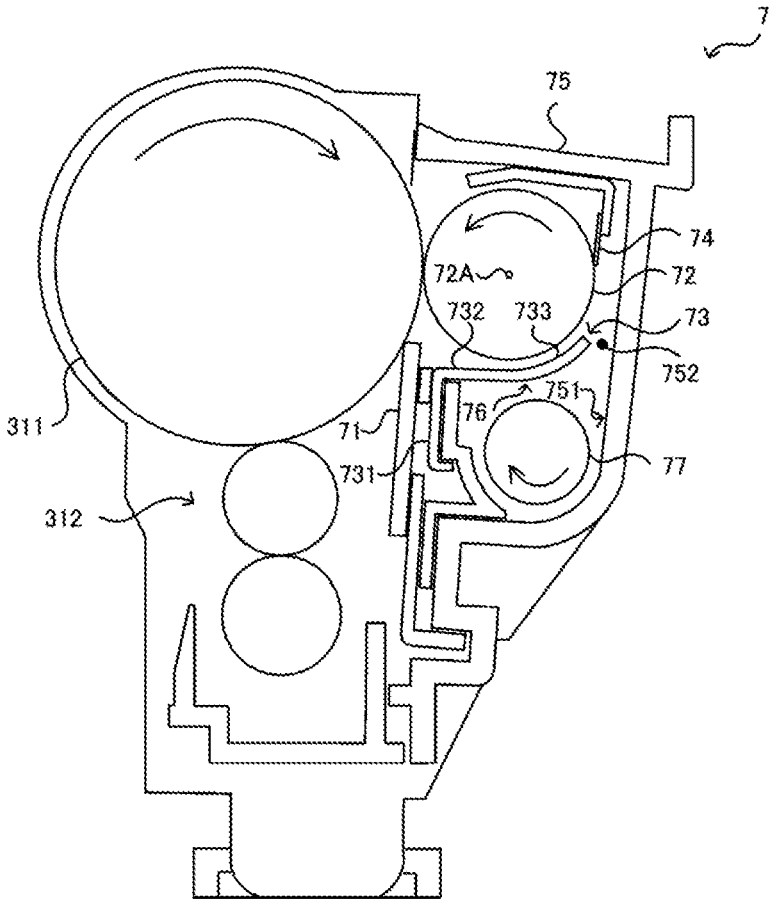
FIG. 2 is a diagram showing the configuration of a cleaning device of the image forming apparatus according to the embodiment of the present invention.
Figure 3:
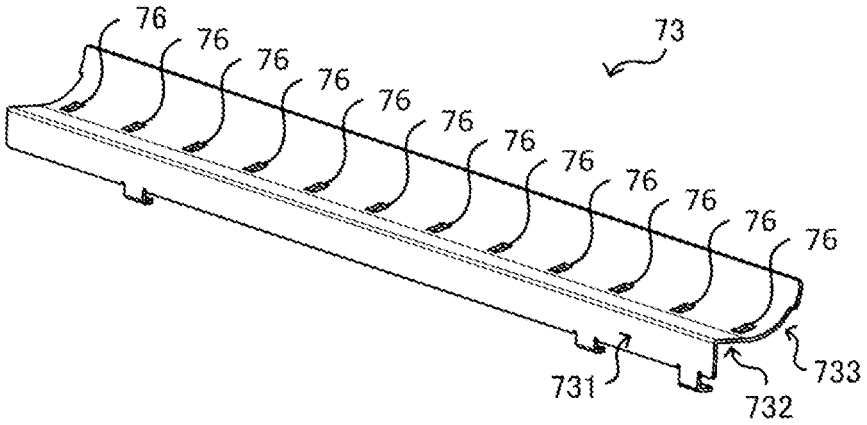
FIG. 3 is a diagram showing the configuration of a guide portion of the image forming apparatus according to the embodiment of the present invention.
Figure 4:
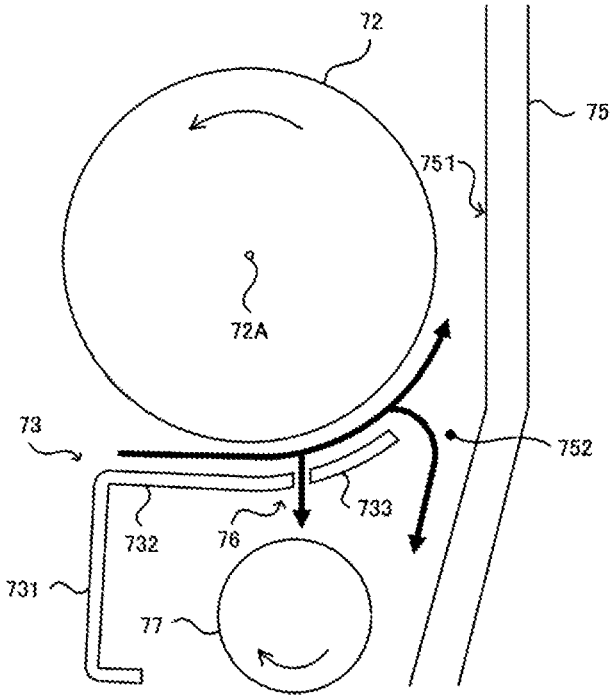
FIG. 4 is a diagram showing a movement path of toner that is guided by the guide portion of the image forming apparatus according to the embodiment of the present invention.

The following describes the configuration of the cleaning device 7 with reference to FIG. 2 to FIG. 4. Here, FIG. 2 is a schematic cross-sectional view of the cleaning device 7. In addition, FIG. 3 is a perspective view of a guide portion 73. Furthermore, FIG. 4 is a diagram showing a movement path of toner that is guided by the guide portion 73, wherein the thick-line arrows represent the toner movement path. It is noted that since the configuration of the cleaning device 7 is common to the image forming units 31-34, only the cleaning device 7 provided in the image forming unit 31 is described.

As shown in FIG. 2, the cleaning device 7 includes a cleaning portion 71, a polishing roller 72, a guide portion 73, a scraper 74, a housing 75, opening portions 76, and a toner conveying portion 77.

The cleaning portion 71 removes the toner that has stuck to the surface of the photoconductor drum 311. The cleaning portion 71 is, for example, a rubber blade that is formed from urethane rubber into a shape of a blade. As shown in FIG. 2, one end of the cleaning portion 71 is fixed to the housing 75, and a tip of the other end abuts on the surface of the photoconductor drum 311. This allows a nip portion to be formed between the photoconductor drum 311 and the cleaning portion 71, and the toner that has stuck to the surface of the photoconductor drum 311 is removed by the cleaning portion 71. The toner removed by the cleaning portion 71 moves as the polishing roller 72 rotates. At this time, the toner is guided by the guide portion 73.

As shown in FIG. 2, the polishing roller 72 is rotatable in the state where it is in contact with the photoconductor drum 311. In addition, the toner removed by the cleaning portion 71 sticks to the surface of the polishing roller 72. Here, in the image forming apparatus 10, an abrasive material such as titanium oxide is externally added to the toner that is used for image formation. With this configuration, the polishing roller 72 with toner having stuck to the surface thereof removes discharge products that have stuck to the surface of the photoconductor drum 311 when the polishing roller 72 rotates while being in contact with the photoconductor drum 311. The surface of the polishing roller 72 is formed from, for example, foamed rubber such as conductive foamed EPDM so as to facilitate the sticking of the toner thereto.

The guide portion 73 is disposed with a gap having a predetermined width from the outer circumferential surface of the polishing roller 72, and guides the toner removed by the cleaning portion 71 to pass below the outer circumferential surface of the polishing roller 72. Specifically, as shown in FIG. 3, the guide portion 73 includes an attachment portion 731, a toner receiving portion 732, and a curved surface portion 733. The attachment portion 731 is used to attach the guide portion 73 to the housing 75. The toner receiving portion 732 temporarily collect the toner that has been removed by the cleaning portion 71. The curved surface portion 733 is formed in the shape of an arc extending from the toner receiving portion 732 along the outer circumferential surface of the polishing roller 72.

As shown in FIG. 2, in the guide portion 73, at a position below the polishing roller 72, the gap is formed between the curved surface portion 733 and the outer circumferential surface of the polishing roller 72. The width of the gap is, for example, 1 mm. It is noted that the width of the gap may be adjusted as appropriate by the guide portion 73, by taking account of the thickness of a toner layer formed on the surface of the polishing roller 72.

As shown in FIG. 4, in the guide portion 73, the toner collected in the toner receiving portion 732 is guided to an end of the curved surface portion 733 of the guide portion 73 along the rotation direction of the polishing roller 72. At this time, part of the toner guided by the guide portion 73 sticks to the surface of the polishing roller 72 when passing through the gap formed between the curved surface portion 733 and the polishing roller 72. In addition, toner that has been guided to the end of the curved surface portion 733 without sticking to the surface of the polishing roller 72 falls toward the toner conveying portion 77 from a gap formed between the end of the curved surface portion 733 and a wall surface 751 of the housing 75.

As shown in FIG. 2, the scraper 74 is disposed on the downstream side of the guide portion 73 in the rotation direction of the polishing roller 72, and restricts the thickness of the layer of toner that has stuck to the surface of the polishing roller 72. The scraper 74 is, for example, a sheet metal formed from SUS or the like. The scraper 74 is disposed to abut on the surface of the polishing roller 72 and scrapes off unnecessary thickness of the toner layer that is formed on the surface of the polishing roller 72 by the guide portion 73.

As shown in FIG. 2, the housing 75 stores the cleaning portion 71 and the polishing roller 72. In addition, the housing 75 includes the wall surface 751 that defines, together with the end of the guide portion 73 in the rotation direction of the polishing roller 72, a falling path 752 through which the toner falls from the end of the guide portion 73. Here, downsizing of the housing 75 is made possible if the falling path 752 is narrowed by allowing the wall surface 751 of the housing 75 to be close to the end of the curved surface portion 733 of the guide portion 73. On the other hand, the toner that falls from the end of the curved surface portion 733 is likely to clog the falling path 752 if the wall surface 751 of the housing 75 is close to the end of the curved surface portion 733 of the guide portion 73.

The opening portions 76 are formed in a predetermined size at a position below the outer circumferential surface of the polishing roller 72 in the guide portion 73. It is noted that as shown in FIG. 4, the opening portions 76 are provided between the toner receiving portion 732 and the curved surface portion 733 in the guide portion 73. With the opening portions 76 formed in the guide portion 73, the toner discharge path divides as shown in FIG. 4, and the discharge amount of toner discharged from the end of the curved surface portion 733 is reduced. With this configuration, the accumulation of toner on the wall surface 751 of the housing 75 in the vicinity of the falling path 752 is restricted, and the possibility of the toner clogging in the falling path 752 is reduced. In addition, since this makes it possible to narrow the width of the falling path 752, the downsizing of the housing 75 is made possible. It is noted that the size of the opening portions 76 may be set as appropriate by taking account of the discharge amount of toner discharged from the end of the curved surface portion 733 and the thickness of the toner layer formed on the surface of the polishing roller 72.

Here, as shown in FIG. 3, in the curved surface portion 733 of the guide portion 73, the opening portions 76 are formed at a predetermined interval along the axis direction of the polishing roller 72. This restricts local variation of the amount of toner that sticks to the polishing roller 72, in the axis direction of the polishing roller 72. Here, by reducing the size of the opening portions 76 and setting the interval to be short, it is possible to uniform the toner amount in the axis direction of the polishing roller 72 while securing the amount of toner that falls through the opening portions 76. It is noted that when the interval is too short, the guide portion 73 will have an insufficient strength. As a result, the interval is desirably set as appropriate by taking account of the strength of the guide portion 73. In addition, the variation of toner amount in the axis direction of the polishing roller 72 that occurs in the opening portions 76 is considered to be gradually uniformed as the polishing roller 72 rotates. As a result, the size and the interval of the opening portions 76 are desirably set by taking account of the arrangement position of the opening portions 76 in the curved surface portion 733.

It is noted that in the image forming apparatus 10, as shown in FIG. 4, the end of the curved surface portion 733 of the guide portion 73 in the rotation direction of the polishing roller 72 is positioned below a shaft 72A of the polishing roller 72. As a result, compared to the case where the end of the curved surface portion 733 is positioned at the same height as the shaft 72A of the polishing roller 72, the space between the end of the curved surface portion 733 and the wall surface 751 of the housing 75 is widened. This makes a further downsizing of the housing 75 possible. Here, when the position of the end of the curved surface portion 733 is too low, the toner layer formed on the surface of the polishing roller 72 may have an insufficient layer thickness. As a result, the position of the end of the curved surface portion 733 is desirably set as appropriate by taking account of the thickness of the toner layer formed on the surface of the polishing roller 72. In addition, when the distance between the opening portions 76 and the end of the curved surface portion 733 is too short, the variation of the toner amount in the axis direction of the polishing roller 72 in the guide portion 73 is not sufficiently uniformed, and the layer thickness of the toner layer formed on the surface of the polishing roller 72 may be varied in the axis direction of the polishing roller 72. As a result, from a viewpoint of securing the distance for uniforming the variation of the toner amount in the axis direction of the polishing roller 72, the formation position of the opening portions 76 may be shifted to the toner receiving portion 732 side.

The toner conveying portion 77 is stored in the housing 75, and conveys the toner that falls via the opening portions 76 and the falling path 752 to a predetermined discharge destination. The toner conveying portion 77 is, for example, a conveyance screw that can convey the toner in the axis direction of the polishing roller 72. In addition, the discharge destination is a toner storage container (not shown) that is provided at an end of the polishing roller 72 in the axis direction. As shown in FIG. 4, the toner conveying portion 77 is disposed below the opening portions 76 and the falling path 752 of the guide portion 73, and can convey both the toner that falls through the opening portions 76 and the toner that falls through the falling path 752. As a result, the image forming apparatus 10 does not need to include a plurality of members for conveying the toner to the toner storage container.

As described above, in the image forming apparatus 10, the opening portions 76 are provided in the guide portion 73 of the cleaning device 7. This reduces the possibility of clogging with toner that is discharged from the end of the guide portion 73, and makes the downsizing of the housing 75 possible.

It is noted that, as another embodiment, the size and the interval of the opening portions 76 and the position of the end of the guide portion 73 may be set as appropriate and the function of the scraper 74 may be replaced with the guide portion 73. This provides a simple configuration of the cleaning device 7.

Figure 5:
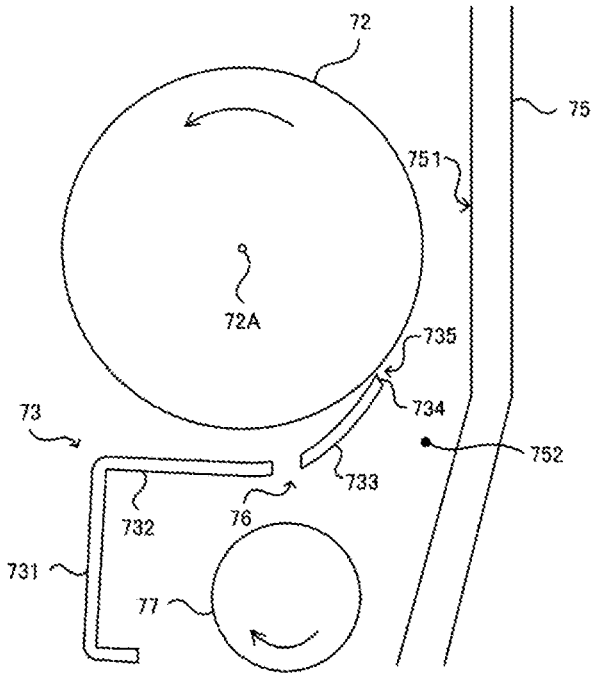
FIG. 5 is a diagram showing another example of the guide portion of the image forming apparatus according to the embodiment of the present invention.

FIG. 5 is a diagram showing an example of the shape of the guide portion 73 in the case where the toner layer thickness of the polishing roller 72 is restricted by the guide portion 73. As shown in FIG. 5, the guide portion 73 is formed such that an end 734 of the guide portion 73 in the rotation direction of the polishing roller 72 is formed so as to form a gap 735 between the end 734 and the polishing roller 72, wherein the gap 735 restricts the toner layer thickness of the polishing roller 72. In that case, since the amount of toner that passes through the gap 735 between the polishing roller 72 and the end 734 is small, the opening portions 76 are considered to be larger in size than those in the configuration of FIG. 4. In addition, the interval of the opening portions 76 in the axis direction of the polishing roller 72 is considered to be shorter than that in the configuration of FIG. 4.

The invention claimed is:

1. An image forming apparatus comprising:

a cleaning portion configured to remove toner that has stuck to a surface of an image carrier;

a polishing roller that is rotatable while being in contact with the image carrier;

a guide portion disposed with a gap having a predetermined width from an outer circumferential surface of the polishing roller, and configured to guide the toner removed by the cleaning portion to pass below the outer circumferential surface of the polishing roller;

opening portions each formed in a predetermined size at a position below the outer circumferential surface of the polishing roller in the guide portion; and a housing including a wall surface that defines, together with an end of the guide portion in a rotation direction of the polishing roller, a falling path through which the toner falls from the end, the housing storing the cleaning portion and the polishing roller, wherein the end of the guide portion in the rotation direction of the polishing roller is positioned below a shaft of the polishing roller.

2. The image forming apparatus according to claim 1, wherein the guide portion includes:

a toner receiving portion configured to temporarily collect the toner removed by the cleaning portion; and a curved surface portion formed in a shape of an arc extending from the toner receiving portion along the outer circumferential surface of the polishing roller, and the opening portions are provided between the toner receiving portion and the curved surface portion.

3. The image forming apparatus according to claim 1, wherein the opening portions are formed at a predetermined interval along the axis direction of the polishing roller.

4. The image forming apparatus according to claim 1, further comprising a toner conveying portion stored in the housing and configured to convey toner that falls via the opening portions and the falling path to a predetermined discharge destination.

5. The image forming apparatus according to claim 1, wherein the guide portion restricts toner layer thickness of the polishing roller.

6. The image forming apparatus according to claim 5, wherein a gap configured to restrict the toner layer thickness of the polishing roller is formed between the end of the guide portion in the rotation direction of the polishing roller and the polishing roller.

* * * * *